US005697818A

United States Patent [19]

Fukuda

[11] Patent Number: 5,697,818

[45] Date of Patent: Dec. 16, 1997

[54] CONNECTOR WITH STRAIGHT METAL TERMINALS

[75] Inventor: Masaru Fukuda, Shizuoka, Japan

[73] Assignee: Yazaki Corporation, Tokyo, Japan

[21] Appl. No.: 621,642

[22] Filed: Mar. 26, 1996

[30] Foreign Application Priority Data

Mar. 27, 1995 [JP] Japan ..... HEI.7-067600

[51] Int. Cl.[6] ..... H01R 13/436

[52] U.S. Cl. ..... 439/751

[58] Field of Search ..... 439/751, 873

[56] References Cited

U.S. PATENT DOCUMENTS

| | | | |
|---|---|---|---|
| 5,046,153 | 9/1991 | Konopa et al. | 439/751 |
| 5,106,310 | 4/1992 | Krajewski et al. | 439/751 |
| 5,190,483 | 3/1993 | Viselli | 439/751 |

FOREIGN PATENT DOCUMENTS

| | | | |
|---|---|---|---|
| 48384 | 2/1989 | Japan | 439/751 |
| 6-203927 | 7/1994 | Japan . | |
| 6-215831 | 8/1994 | Japan . | |

*Primary Examiner*—Gary F. Paumen

*Attorney, Agent, or Firm*—Sughrue, Mion, Zinn, Macpeak & Seas,PLLC

[57] ABSTRACT

There is disclosed a connector in which a straight terminal, passed through a support through hole in a connector housing, is pressed at its free end portion against a support wall portion, thereby enhancing a dimensional accuracy. In a condition in which the straight terminal is inserted through the support through hole, a resiliency-applying bent portion, beforehand formed on the straight terminal, is subjected to a deforming force in a direction tending to bring the bent portion into a straight condition, so that the free end portion of the straight terminal is pressed against the support wall portion.

4 Claims, 3 Drawing Sheets

CONNECTOR WITH STRAIGHT METAL TERMINALS

BACKGROUND OF THE INVENTION

1. Field of the Invention

This invention relates to a connector used for connecting a wire harness or the like, and more particularly to a connector having straight metal terminals of the pin type, the plate type or the like.

2. Background

In FIG. 4, a male connector housing A and a female connector housing B for a printed wiring board are both molded of a synthetic resin.

A plurality of terminal receiving chambers 10 are formed in the male connector housing A, and female metal terminals C are inserted respectively into these terminal receiving chambers, and are retained there (see FIG. 5). Male metal terminals D of the pin type extend through a rear wall 11 of the female connector housing B to be supported by this rear wall 11, and are arranged parallel to one another within a hood portion 12 (see FIG. 5).

An elastic lock arm 14 of the cantilever type, having an upstanding proximal (front) end portion 14*a*, is provided in a recess 13 formed in an upper surface of the male connector housing A, and extends rearwardly. A lock projection 14*b* is formed on a central portion of an upper surface of the elastic lock arm 14, and a lock release press portion 14*c* is formed at a free end of this elastic lock arm 14. An engagement frame portion 16 for the elastic lock arm 14 is formed at a front end of an upper wall 15 of the female connector housing B, and is disposed centrally of the width thereof, and a retaining hole 16*a* for the lock projection 14*b* is formed through this upper wall 15.

When the male and female connector housings A and B are fitted together, the female metal terminals C contact the male metal terminals D, respectively, and at this time the lock projection 14*b* of the elastic lock arm 14 is brought into engagement with a front end of the engagement frame portion 16, so that the elastic lock arm 14 is elastically deformed downward into a deformation-allowing space $R_1$ disposed below this lock arm 14, and then when the lock projection 14*b* reaches the retaining hole 16*a*, the elastic lock arm 14 is restored, thereby locking the male and female connector housings A and B together in a completely-connected condition (see FIG. 6).

Within the hood portion 12 of the female connector housing B, a support wall portion 17 extends forwardly from the rear wall 11, and is disposed in registry with the engagement frame portion 16. The support wall portion 17 has a horizontal plate portion 17*a* and a partition wall portion 17*b* formed on the horizontal plate portion 17*a*, the partition wall portion 17*b* extending centrally of the width of the horizontal plate portion 17*a*, so that the support wall portion 17 has a generally T-shaped cross-section. A pair of connection detection metal terminals D' of the pin type, extending through the rear wall 11, are disposed on opposite sides of the partition wall 17*b*, respectively, and the pin-type connection detection metal terminals D', together with the support wall portion 17, extend forwardly beyond the pin-type male metal terminals D (see FIG. 5).

An opening 18 of a substantially T-shaped cross-section for receiving the support wall portion 17 is formed in the male connector housing A, and extends rearwardly, this opening 18 being disposed in registry with the elastic lock arm 14. A support chamber 20 for a short-circuiting contact member 19 is provided beneath the opening 18, and is open at its front end.

The short-circuiting contact member 19 is fixedly fitted at its proximal end portion 19*a* in the support chamber 20, and a pair of resilient contact piece portions 19*c*, extending rearwardly, have respective short-circuiting contact portions 19*e* which are spaced a distance $R_2$ from a bottom wall 13*a* of the recess 13 in opposed relation thereto. A driven portion 19*d* extends through a notch $13a_1$, formed through the bottom wall 13*a*, into the recess 13, and is held against a lower side of the lock release press portion 14*c* of the elastic lock arm 14 (see FIG. 5).

In the condition shown in FIG. 5, when the connection between the male and female connector housings A and B begins, the support wall 17 and the pin-type connection detection metal terminals D' enter the opening 18. When the connection further proceeds, the front end portions of the support wall portion 17 and the pin-type connection detection metal terminals D' enters the space $R_2$, and at this time the lock projection 14*b* engages a lower surface of the engagement frame portion 16, so that the elastic lock arm 14 is elastically deformed into the deformation-allowing space $R_1$. When the elastic lock arm 14 is thus elastically deformed, the resilient contact piece portions 19*c* of the short-circuiting contact member 19 are also deformed in a direction to increase the space $R_2$, so that the pin-type connection detection metal terminals D' are held out of contact with the short-circuiting contact member 19.

When the male and female connector housings A and B are completely connected together, the elastic lock arm 14 is restored, and also the pair of resilient contact piece portions 19*c* of the short-circuiting contact member 19 are restored, so that the short-circuiting contact portions 19*e* contact the pair of pin-type connection detection metal terminals D' and D', respectively, thereby operating an electrical detection circuit (see FIG. 6).

In the above conventional construction, the pin-type metal terminals D', supported by the support wall portion 17, are press-fitted respectively in support through holes 11*a* formed through the rear wall 11 in proximity to the support wall portion 17. In this case, the pin-type metal terminals D' are supported in a cantilever manner, and their free ends 22 are remote from the support through holes 11*a*. Therefore, the free ends 22 tend to be spaced from the surface of the support wall portion 17, thus inviting a problem with the quality control of a dimension L. If the dimension L is not properly maintained, each metal terminal D' is not properly held out of contact with the resilient contact piece portion 19 in a half-fitted condition of the male connector housing A, and also each metal terminal D' can not properly contact the resilient contact piece 19 in a fitted condition of the male connector housing A.

And besides, the cantilever supporting of the pin-type metal terminal D' depends mainly on the support through hole 11*a*, and the peripheral surface of the pin-type metal terminal D' is adapted to be in close contact with the inner surface of the support through hole 11*a*, and therefore the pin-type metal terminal D' can not be easily inserted through the support through hole 11*a*.

SUMMARY OF THE INVENTION

With the above problems in view, it is an object of this invention to provide a connector in which each of straight metal terminals (e.g. pin-type metal terminals), fitted in a support through hole, is always held at its free end in intimate contact with a support wall portion.

The above object of the present invention has been achieved by a connector including a connector housing having a support wall portion provided in proximity to support through holes; and straight terminals inserted respectively through the support through holes, the support wall portion extending in a direction of insertion of the straight terminals, and the straight terminals being supported by the respective support through holes and the support wall portion. In a condition in which each of the straight terminals is inserted through the associated support through hole, a resiliency-applying bent portion, beforehand formed on the straight terminal, is subjected to a deforming force in a direction tending to bring the bent portion into a straight condition, so that a free end portion of the straight terminal is pressed against the support wall portion.

In the attached condition of the straight terminal, the preformed, bent portion is subjected to a force tending to bring this bent portion into a straight condition, so that the free end portion of the straight terminal is pressed against the support wall portion.

DESCRIPTION OF THE PREFERRED EMBODIMENT OF THE INVENTION

Figure 1:
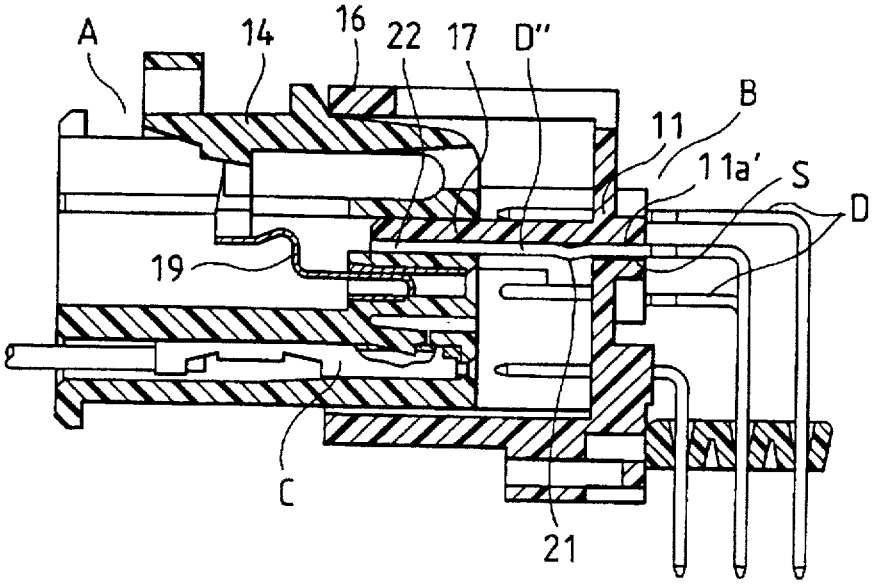
FIG. 1 is a cross-sectional view of one preferred embodiment of the present invention.

In FIG. 1, most of internal structure portions of male and female connector housings A and B are similar to those of the conventional construction, and those portions identical to those of the conventional construction are designated by identical reference numerals, respectively. FIG. 1 shows an initial stage of the connection between the male and female connector housings A and B.

Figure 2:
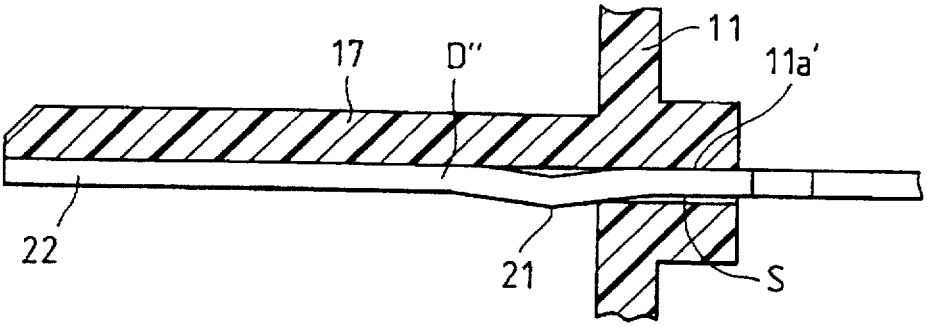
FIG. 2 is an enlarged, cross-sectional view of an important portion of the embodiment.
Figure 3:
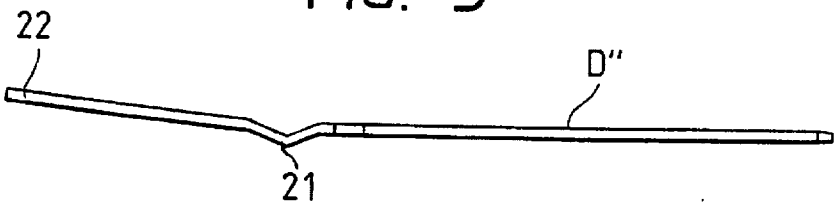
FIG. 3 is a side-elevational view of a straight terminal before it is attached.
Figure 4:
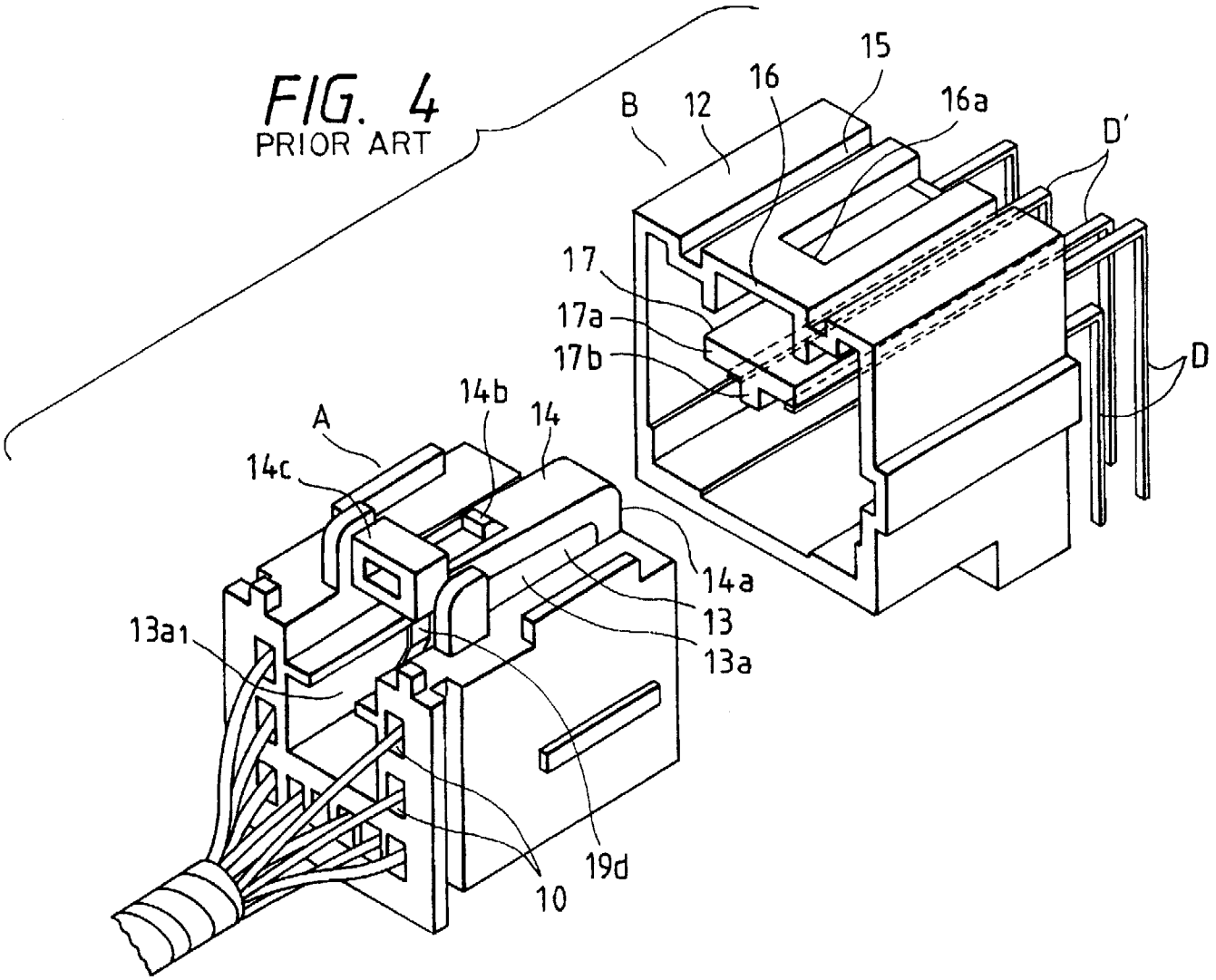
FIG. 4 PRIOR ART
FIG. 4 is a perspective view of male and female connector housings of a conventional construction separated from each other.
Figure 5:
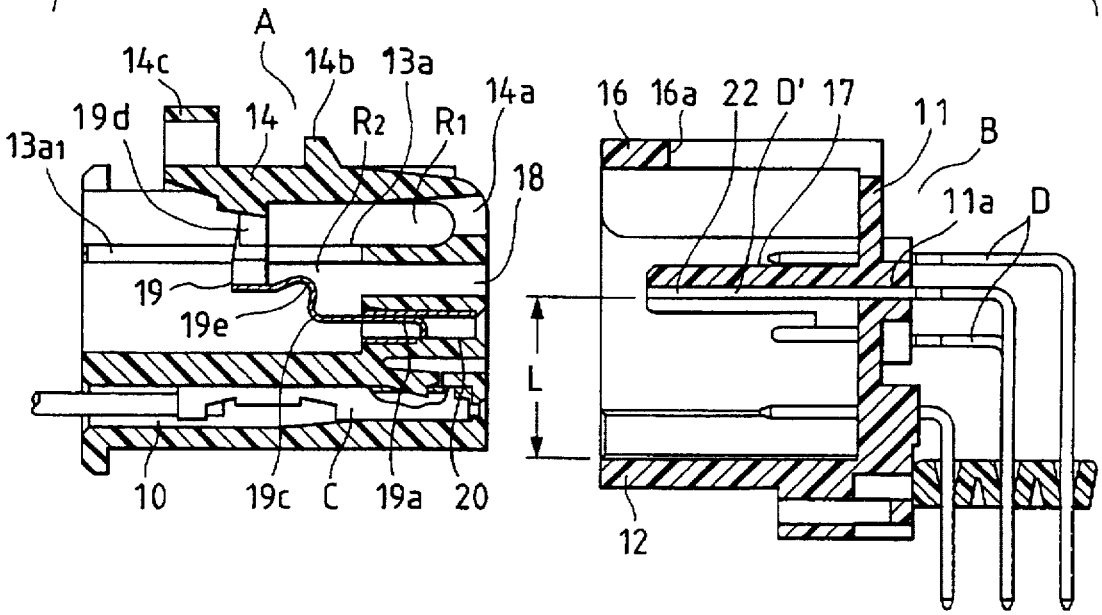
FIG. 5 PRIOR ART
FIG. 5 is a cross-sectional view of the conventional construction.
Figure 6:
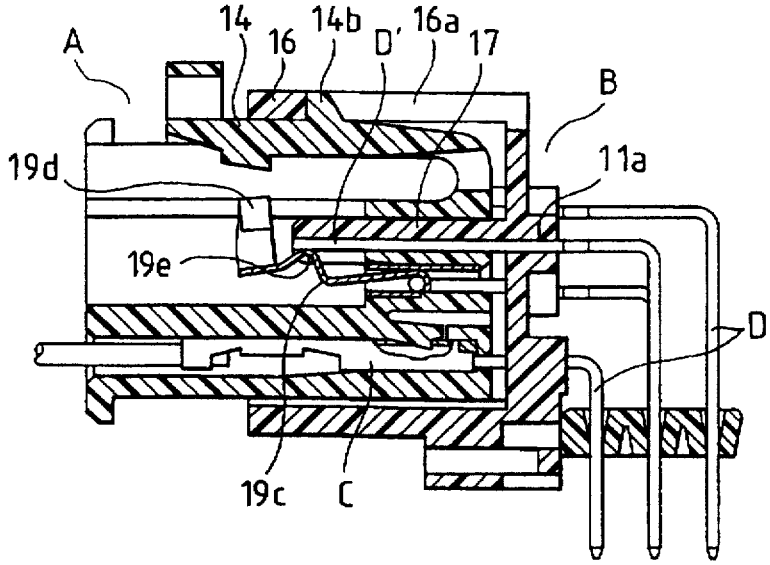
FIG. 6 PRIOR ART
FIG. 6 is a cross-sectional view of the conventional construction showing a condition in which the two connector housings are connected together.

In the female connector housing B, a support wall portion 17 is formed integrally with a rear wall 11, and extends perpendicularly from this rear wall 11 into the interior of the female connector housing B. Support through holes 11*a'* for pin-type connection detection metal terminals D" are formed through the rear wall 11 in proximity to a proximal end of the support wall portion 17, the support through holes 11*a'* being slightly larger in diameter than the support through holes 11*a* in the conventional construction. Therefore, a slight clearance S exists between the support through hole 11*a'* and the pin-type connection detection metal terminal D" inserted therethrough (see FIG. 2). The support wall portion 17 extends in a direction of extending of the pin-type connection detection metal terminals D".

The pin-type connection detection metal terminal D" is a straight metal terminal which is straight except for its rear portion defining an electrical connection portion, and more specifically that portion of this terminal inserted in the female connector housing B is straight. Another example of such straight metal terminal other than the pin-type terminal is a plate-type terminal. In the present invention, a resiliency-applying bent portion 21 in a substantially V-shape is beforehand formed on the pin-type connection detection metal terminal (straight metal terminal) D". In the attached condition of the pin-type connection detection metal terminal D", the resiliency-applying bent portion 21, passed through the support through hole 11*a'*, is disposed near to the support through hole 11*a'*, and because of the support wall portion 17 and the support through hole 11*a'*, the resiliency-applying bent portion 21 is subjected to a deforming force in a direction tending to increase the angle of bending of the bent portion 21, that is, in a direction tending to bring the bent portion 21 into a straight condition. As a result of this reaction, a free end portion 22 of the metal terminal D" is pressed against the support wall portion 17, so that the attached condition of the metal terminal supported by the support wall portion 17 is made constant, thereby enhancing the dimensional precision.

As described above, in the present invention, the connector includes the connector housing having the support wall portion provided in proximity to the support through holes, and the straight terminals inserted respectively through the support through holes, the support wall portion extending in a direction of insertion of the straight terminals, and the straight terminals being supported by the respective support through holes and the support wall portion. In the condition in which each of the straight terminals is inserted through the associated support through hole, the resiliency-applying bent portion, beforehand formed on the straight terminal, is subjected to a deforming force in a direction tending to bring the bent portion into a straight condition, so that the free-end portion of the straight terminal is pressed against the support wall portion. Therefore, the attached condition of the straight metal terminal supported by the support wall portion is made constant, thereby enhancing the dimensional precision related to the connection of the mating connector housing to this connector housing.

What is claimed is:

1. A connector, comprising:

a housing having a rear wall with a support through hole formed therein;

a terminal having front and back end portions wherein said front end portion is angled upwardly from the longitudinal axis of said back end portion; and a support wall portion formed in said housing, said support wall portion being provided in proximity to the support through hole to extend in a direction of insertion of said terminal, wherein said terminal inserted through the support through hole is supported by the support through hole and said support wall portion, and wherein, the angled front end portion is subjected to a deforming force in a direction tending to bring the angled front end into a straight condition, so that the front end portion of said terminal is pressed against said support wall portion.

2. The connector of claim 1, wherein said angled front end portion is formed on said terminal in proximity to an inner end of the support through hole.

3. The connector of claim 2, wherein said angled front end portion has a substantially V-shape.

4. The connector of claim 1, wherein the support through hole is larger than a width of said terminal so that a clearance is produced when said terminal is inserted through the support through hole.

* * * * *